US006872294B2

(12) United States Patent
Lee et al.

(10) Patent No.: US 6,872,294 B2
(45) **Date of Patent: *Mar. 29, 2005**

(54) METALLIZATION OF POLYMER COMPOSITE PARTS FOR PAINTING

(75) Inventors: Hsai-Yin Lee, Troy, MI (US); Yar-Ming Wang, Troy, MI (US); Tao Xie, Rochester Hills, MI (US)

(73) Assignee: General Motors Corporation, Detroit, MI (US)

( * ) Notice: Subject to any disclaimer, the term of this patent is extended or adjusted under 35 U.S.C. 154(b) by 409 days.

This patent is subject to a terminal disclaimer.

(21) Appl. No.: 10/135,181

(22) Filed: Apr. 30, 2002

(65) Prior Publication Data

US 2003/0201186 A1 Oct. 30, 2003

(51) Int. Cl.[7] ..... C25D 5/56; C25D 15/00; C23C 28/00

(52) U.S. Cl. ..... 205/164; 205/166; 205/167; 205/168; 205/169; 205/196; 204/484; 204/486; 204/487; 204/488

(58) Field of Search ..... 204/484, 486, 204/487, 488; 205/164, 166, 167, 168, 169, 196

(56) References Cited

U.S. PATENT DOCUMENTS

| | | | | |
|---|---|---|---|---|
| 3,955,017 A | | 5/1976 | Colebourne et al. | 427/383 |
| 4,039,714 A | * | 8/1977 | Roubal et al. | 428/336 |
| 2004/0050703 A1 | * | 3/2004 | Lee et al. | 204/487 |

* cited by examiner

*Primary Examiner*—Edna Wong
(74) *Attorney, Agent, or Firm*—Kathryn A. Marra

(57) ABSTRACT

The quality of painted surfaces of polymer composites is improved by first forming an electroless metal coating on the molded surface of the composite and then electroplating a coating of zinc or zinc alloy on the metallized composite surface. The "galvanized" composite surface provides a good base for electrostatic deposition of either liquid or powder paint and the zinc surface prevents the formation of defects in the painted surface during heating of the composite to dry or cure the paint film.

13 Claims, No Drawings

METALLIZATION OF POLYMER COMPOSITE PARTS FOR PAINTING

TECHNICAL FIELD

This invention pertains to a method of preparing polymer composite parts for painting. For example, it is applicable to all the major polymer composite substrates considered for automotive body parts. More specifically this invention pertains to the application of a zinc based coating to all surfaces of such parts to virtually eliminate the occurrence of surface and edge defects during subsequent painting and paint baking operations.

BACKGROUND OF THE INVENTION

The term "polymer composite" broadly refers to polymer based compositions that are formulated to contain additives to improve their properties for a specific application. The polymer composites may contain, for example, reinforcing fibers, fillers, pigments and other polymers. Polymer composite components are available for use in many commercial applications. They offer great potential as relatively low weight body panels and other components in automotive vehicles.

In the case of automotive vehicle body panel applications, polymer composites include, for example, compression molded sheet molding compound (SMC) containing unsaturated polyester and polystyrene resins, reinforced reaction injection molded (RRIM) polyureas, or injection molded products containing poly (phenylene oxide) (PPO)/nylon based resins. Such polymer composite parts are lighter than comparably sized steel panels. However, the composites do have to be painted for body panel applications, and it has been difficult to paint the composite body panels without introducing surface defects.

Automotive painting operations are typically carried out on a body-in-white. A body-in-white is the unpainted unitary body structure comprising welded, or otherwise attached, body panels and structural components. Such a body structure is usually formed mostly of steel panels but now may include some polymer composite panels. The paint shop practice is established for the steel portion of the body which is electrically conductive and receives several coating layers for corrosion resistance, paint adhesion and painted surface finish quality. The composite panels do not respond to the several coating procedures in the same way as the steel panels. For example, automotive painting operations often involve the separate application of a zinc phosphate layer, an electrocoated liquid (i.e., using water or an organic solvent) prime, a liquid or powder primer surfacer layer, a liquid base color coat and a liquid or powder clear top coat. But there is no deposition of either the zinc phosphate coating or the electrocoated prime on the typical composite panel surfaces.

Following each of the prime coat, the primer surfacer and the clear top coat applications there is a baking step at temperatures of 250° F. or higher to cure or dry the new layer and to promote flow of the top coat films to a commercially acceptable finish for a vehicle. Such aggressive heating of the painted composites typically leads to "out-gassing." Out-gassing is the release of entrapped air, solvent, moisture, and uncured chemicals and polymer precursor materials from the somewhat porous composite substrate. The result too often is an unsightly and unacceptable rough surface. Out-gassing was initially experienced with liquid primer surfacer paints at their 250° F. bake temperature. The occurrence of surface roughness with such paint systems has been reduced in some instances by the use of a special formulated, electrically conductive polymer prime coat as a barrier coat after molding. This polymeric prime coat on the composite surface may reduce out-gassing at that location. But this coating doesn't appear to work for all molded polymer composite and liquid paint combinations, and it completely fails to prevent out-gassing during the flow and curing of powder paints which require even higher bake temperatures (350° F.).

Accordingly, it is an object of the invention to provide a method of treating the surfaces of polymer composite articles of manufacture to avoid out-gassing caused defects during post-molding painting operations. More specifically, it is an object of this invention to provide a conductive metal coating on molded polymer composite surfaces to permit, for example, the phosphating and subsequent prime coatings and top coatings of automotive body panels yielding uniform appearing and high quality surface finishes.

SUMMARY OF THE INVENTION

This invention is applicable to the painting of surfaces of polymer composite parts. It is a method that results in the formation of a zinc or zinc based alloy coating on the composite surface prior to painting. The zinc coating prepares the surface of the composite part for phosphating or the like, if desired. The zinc layer makes the surface of the composite conductive for electrostatic painting with liquid (solvent or water based) or dry powder paints, and it provides an impermeable layer to prevent out-gassing from the composite into paint layers, especially during paint drying or curing steps.

The method is applicable to any polymer composite part. The practice of this invention is not limited by any specific earlier preparation of the composite part, but a description of typical composite molding steps is helpful in understanding the use of the invention.

After a suitable mixture of polymer composite precursors is prepared, the mixture is molded and, if required, cured. Surfaces of the composite part to be painted are prepared for the deposition of a first conductive layer to permit electrolytic deposition of the zinc layer. Thus, the composite part is typically dipped in an etching solution to roughen and oxidize the surface. After removal of excess etching agents, the surface is treated with a suitable colloidal metal catalyst, often palladium, to provide sites on the surface for an electroless coating of copper or nickel. The thin coating of copper or nickel is then applied. As stated, this electroless copper coating, or a like conductive coating, is the conductive base for the deposition of zinc or suitable zinc galvanizing alloy.

In accordance with the invention, a coating of zinc is then electroplated on the electroless conductive metal coating. In other words, the composite part is "galvanized." The zinc coating better prepares the composite for phosphating and/or electrostatic painting. But most importantly the zinc coating prevents out-gassing during the high temperatures experienced by the part during paint drying and/or curing. The zinc coating is the only known way to prevent such out-gassing following powder coat painting.

Other objects and advantages of the invention will become more apparent from a detailed description of the invention which follows.

DESCRIPTION OF THE PREFERRED EMBODIMENT

An illustrative example will be given of one method of forming a conductive layer on a molded polymer composite article for the subsequent electrodeposition of the zinc coating. The following example is a process for the deposition of a conductive copper layer that has been used to prepare molded polymer articles for electroplating with chromium. This process has been used for this purpose on many different polymeric substrates and therefore has demonstrated wide applicability. However, it is to be understood that other methods can be used to provide a conductive layer on the composite article for deposition of the zinc containing layer that is a critical feature of this invention.

The molded composite part is dipped in an etching solution (e.g. a mixture of sulfuric and chromic acids) to roughen and oxidize the surface. Etching provides a roughened surface for mechanical interlocking with the copper layer to be deposited. The etching also makes the composite surface more hydrophilic for the following process steps. Following a suitable etching period, the part is removed from the etching solution and dipped in a neutralizing rinse to remove residual acids.

The etched composite surface is then treated with an aqueous colloidal suspension of a suitable mixture of tin and palladium chlorides to deposit catalytic nuclei particles of palladium at sites on the surface. The excess tin is then removed from the palladium-activated surface.

The activated composite surface is then contacted with a bath of suitable electroless copper plating composition. The catalyzed composite surface promotes the reduction of the copper compound(s) in the bath to deposit a copper coating film on the surface of the molded composite article. The thickness of the copper film is, for example, about one-half to one micrometer. An electroless nickel deposit may be made instead of the copper layer. But the object of this metal deposition step is to make the composite surface uniformly conductive and receptive to the electroplating of a suitable zinc or zinc alloy coating.

Zinc electroplating of the conductive composite surface can now be accomplished. Zinc or a zinc alloy can be electroplated by any suitable commercial acid or alkaline zinc plating process. An example of a zinc alloy is one containing, for example, six to twelve or thirteen percent by weight nickel. A zinc coating thickness of about fifteen to twenty-five micrometers is preferred. The composite surface is now ready for phosphating and/or painting in accordance with the requirements of the final polymer composite product. However, the zinc coating makes the composite article particularly ready for painting operations of the type carried out in an automotive paint shop.

Following is an outline of a typical automotive painting process for a composite exterior body panel such as a door, fender, rocker panel or the like.

When the zinc coated composite panel reaches the paint shop as part of an automotive body-in-white (i.e., unpainted body), the vehicle body is cleaned and degreased to remove surface contaminants. The whole body, with its steel panels and composite panels, is immersed in a suitable phosphating bath to form an adherent integral layer of phosphate. As is well known in automotive technology, the phosphate layer provides paint adhesion to the body panels and limits corrosion of the panels due to stone chipping or other damage to the vehicle in use. The zinc layer on the composite panel functions like a "galvanized" zinc layer on a steel panel. And the zinc layer on the composite facilitates the formation of the phosphate layer on the composite panel.

After rinsing and drying, the phosphated vehicle body is immersed in an electrolytic bath of prime coat paint composition. This electrocoat primer is electrolytically dispersed over the entire immersed body. Again, the zinc layer on the composite panel portions of the body promotes the deposition of the corrosion resistant primer coating. The vehicle body is removed from the bath, drained, rinsed and then baked at 350° F. or so to cure the prime coat layer and produce a coherent film over the entire body. The zinc layer resists popping of the composite surface during this high temperature exposure of the composite panel.

A liquid or powder primer surfacer coating is then applied to the prime coated body. The liquid or powder primer surfacer paint is usually charged and the body electrically grounded for this purpose to better attract the sprayed coating. The conductive zinc coating on the composite panels assists in this coating operation. This primer surfacer coating is also baked on the vehicle body at a temperature of 250° F. or 350° F., depending on whether the primer surfacer is a liquid or powder based formulation. The zinc coating on the composite layer stops out-gassing at the painted surface.

Similarly a pigmented paint layer is usually also electrostatically applied to the vehicle body followed by a clear topcoat. These layers are also baked for film flow and curing. Still, the zinc coating on the composite panels prevents the formation of surface defects.

Accordingly, this invention provides a way of preparing polymer matrix composite articles for high temperature paint baking operations while avoiding the formation of unsightly defects in the surface of the painted composite body. The practice of forming a zinc based coating on the composite surface enables the wide spread use of composite panels in automotive applications where protective and decorative phosphate and/or paint layers are to be applied.

The invention has been described in terms of an illustrative example. Obviously other practices may be adapted to form useful zinc coatings on composite surfaces and thereby realize the benefits of this invention. Accordingly, the scope of the invention is to be considered limited only by the following claims.

What is claimed is:

1. A method of painting the surface of a polymer composite article, said method comprising:

forming a conductive metal film on surfaces of said composite article that is to be painted, electrolytically depositing a coating of zinc or zinc based alloy on said conductive film, the thickness of said zinc or zinc alloy coating being at least fifteen micrometers, depositing a coating of paint on said zinc or zinc alloy coating and, thereafter baking said paint coating.

2. A method as recited in claim 1 in which said composite article is reinforced with glass fibers.

3. A method as recited in claim 1 further comprising depositing a coating of zinc phosphate on said zinc or zinc alloy coating before depositing said coating of paint.

4. A method as recited in claim 1 comprising baking said paint coating at a temperature of 2500° F. or higher.

5. A method as recited in claim 1 in which said polymer composite comprises an unsaturated polyester and polystyrene resin based sheet molding compound.

6. A method as recited in claim 1 in which said polymer composite comprises reinforced reaction injected molded polyurea resin.

7. A method as recited in claim 1 in which said polymer composite comprises a poly(phenylene oxide)/ nylon resin.

8. A method as recited in claim 1 comprising electrolytically depositing said zinc or zinc based alloy from an acid bath.

9. A method as recited in claim 1 comprising electrolytically depositing said zinc or zinc based alloy from an alkaline bath.

10. A method of painting an electrically conductive surface of a polymer composite article, said method comprising:

electrolytically depositing a coating of zinc or zinc based alloy on said surface; applying a paint layer to said composite article on the surface to which said zinc or zinc alloy coating has been deposited; and, thereafter baking said paint layer, the thickness of said zinc or zinc based alloy coating being sufficient to prevent outgassing of said article during said baking.

11. A method of painting as recited in claim 10 further comprising depositing a coating of zinc phosphate on said composite on the surface to which said zinc or zinc alloy coating has been deposited, said zinc phosphate being deposited before said paint layer is applied.

12. A method of painting as recited in claim 10 further comprising applying a powder primer surfacer coating as said paint layer, and baking said primer surfacer coating.

13. A method of painting as recited in claim 10 comprising baking said layer at a temperature of 250° F. or higher.

* * * * *